US005857372A

United States Patent [19]

Sendzimir et al.

[11] Patent Number: 5,857,372

[45] Date of Patent: Jan. 12, 1999

[54] HOUSING FOR CLUSTER MILLS

[75] Inventors: Michael G. Sendzimir, Woodbury; John W. Turley, Oxford, both of Conn.

[73] Assignee: T. Sendzimir, Inc., Waterbury, Conn.

[21] Appl. No.: 795,547

[22] Filed: Feb. 6, 1997

[51] Int. Cl.[6] ..... B21B 31/00; B21B 13/10; B21B 13/14

[52] U.S. Cl. ..... 72/237; 72/224; 72/241.2

[58] Field of Search ..... 72/224, 225, 237, 72/241.2, 241.4, 242.2, 242.4, 243.2, 243.4

[56] References Cited

U.S. PATENT DOCUMENTS

| | | | |
|---|---|---|---|
| 2,169,711 | 8/1939 | Sendzimit . | |
| 2,187,250 | 1/1940 | Sendzimir . | |
| 2,368,030 | 1/1945 | Larsson | 72/242.4 |
| 2,776,586 | 1/1957 | Sendzimir . | |
| 3,815,401 | 6/1974 | Sendzimir et al. . | |
| 3,858,424 | 1/1975 | Kajiwara et al. | 72/242.4 |
| 4,289,013 | 9/1981 | Hunke | 72/242.4 |
| 5,142,896 | 9/1992 | Berger et al. | 72/242.4 |
| 5,596,899 | 1/1997 | Sendzimir et al. | 72/242.4 |

*Primary Examiner*—Lowell A. Larson
*Assistant Examiner*—Rodney Butler
*Attorney, Agent, or Firm*—Frost & Jacobs LLP

[57] ABSTRACT

A cluster mill housing applicable to 20-high and 12-high cluster mills. The mill housing is similar in size and form to a comparable monobloc housing but is made of four distinct parts. The first part is a floor portion having a central lower roll cavity containing part terminating in end members and having a vertical column at each of its four corners. The second part comprises a roof portion having a central upper roll cavity containing part terminating at each of its ends in ears. The third and fourth parts comprise substantially identical bridge members overlying the roof portion ears and having downturned ends affixed to the tops of the columns. Each of the bridge members contain adjustment screws which bear against the adjacent roof portion ear. A synchronized drive assembly rotates the four adjustment screws equally and in the same direction to adjust the vertical position of the roof portion with respect to the floor portion. Hydraulic counterbalance assemblies are affixed to the bridge members and are connected to the roof portion to support the weight of the roof portion and to maintain the roof portion against the four adjustment screws.

8 Claims, 4 Drawing Sheets

HOUSING FOR CLUSTER MILLS

TECHNICAL FIELD

This invention relates to a housing for cluster mills used for the cold rolling of metal strip, and more particularly to such a housing having the advantages of a two part structure and rigidity close to that of a monobloc structure.

BACKGROUND ART

The majority of cluster mills for cold rolling metal strip have been provided with monobloc housings of the type shown in U.S. Pat. Nos. 2,169,711; 2,187,250 and 2,776,586 or the improved type taught in U.S. Pat. No. 3,815,401 and also illustrated in FIGS. 1*a* and 1*b* herein.

The advantage of the monobloc housing over any other housing type is great rigidity which is required in order to roll strip having the greatest uniformity in thickness. It will be noted by one skilled in the art that, as time progresses, requirements for gauge accuracy (i.e. thickness uniformity) are becoming increasingly stringent.

However, there are some disadvantages with respect to the monobloc housing, which, for some applications, can cause serious difficulties. These disadvantages can be summarized as follows:

Firstly, if a mill wreck occurs, i.e. the strip breaks and then accumulates in a tangled mass of scrap inside the housing, it sometimes takes several hours to remove the tangled strip, to enable rolling to recommence, and so significant lost production occurs. It would be advantageous in such cases to be able to separate upper and lower halves of the housing to provide more room for removal of scrap strip. This is particularly important for high speed mills.

Secondly, for some applications, it would be advantageous to be able to roll with a larger range of work roll diameters than can be achieved with a monobloc housing.

Thirdly, the ability to separate upper and lower halves of the housing would facilitate threading of the strip.

Fourthly, the ability to mount force measuring devices between upper and lower halves of the housing would enable more accurate measurement of roll separating force, which could be useful for purposes of data logging and improving accuracy of automatic gauge control systems.

Prior art alternative housing designs have overcome all of the difficulties, but paid the penalty of a great reduction in mill rigidity. Some examples of such prior art are shown in FIGS. 2, 3*a* and 3*b* of U.S. Pat. No. 5,596,899.

These housings are discussed in the above-noted co-pending application. The above-noted co-pending application, the teachings of which are incorporated herein by reference, discloses a housing that, although overcoming all of the difficulties mentioned above, includes both screws and prestressing cylinders and so would be too expensive for some applications.

It is the object of the present invention to provide a housing for a cluster mill having all the advantages of prior art split housings, while maintaining a housing stiffness almost as high as that of a monobloc housing, and without requiring the use of costly prestressing elements.

DISCLOSURE OF THE INVENTION

According to the invention there is provided a mill housing similar in overall form and size to a monobloc housing, but split into four portions. These portions comprise a lower portion or base substantially identical to the lower portion of a monobloc housing except for the addition of four vertical columns at its corners; an upper portion or roof substantially identical to the roof of a monobloc housing except for the addition of an ear at each side; and two bridge members mounted on and bolted to the lower portion columns, one at each side above one of said ears. On each of said bridge members there are mounted two of the four mill screws and the screwdown drive for these screws.

DETAILED DESCRIPTION OF THE INVENTION

Figures 1A, 1B:
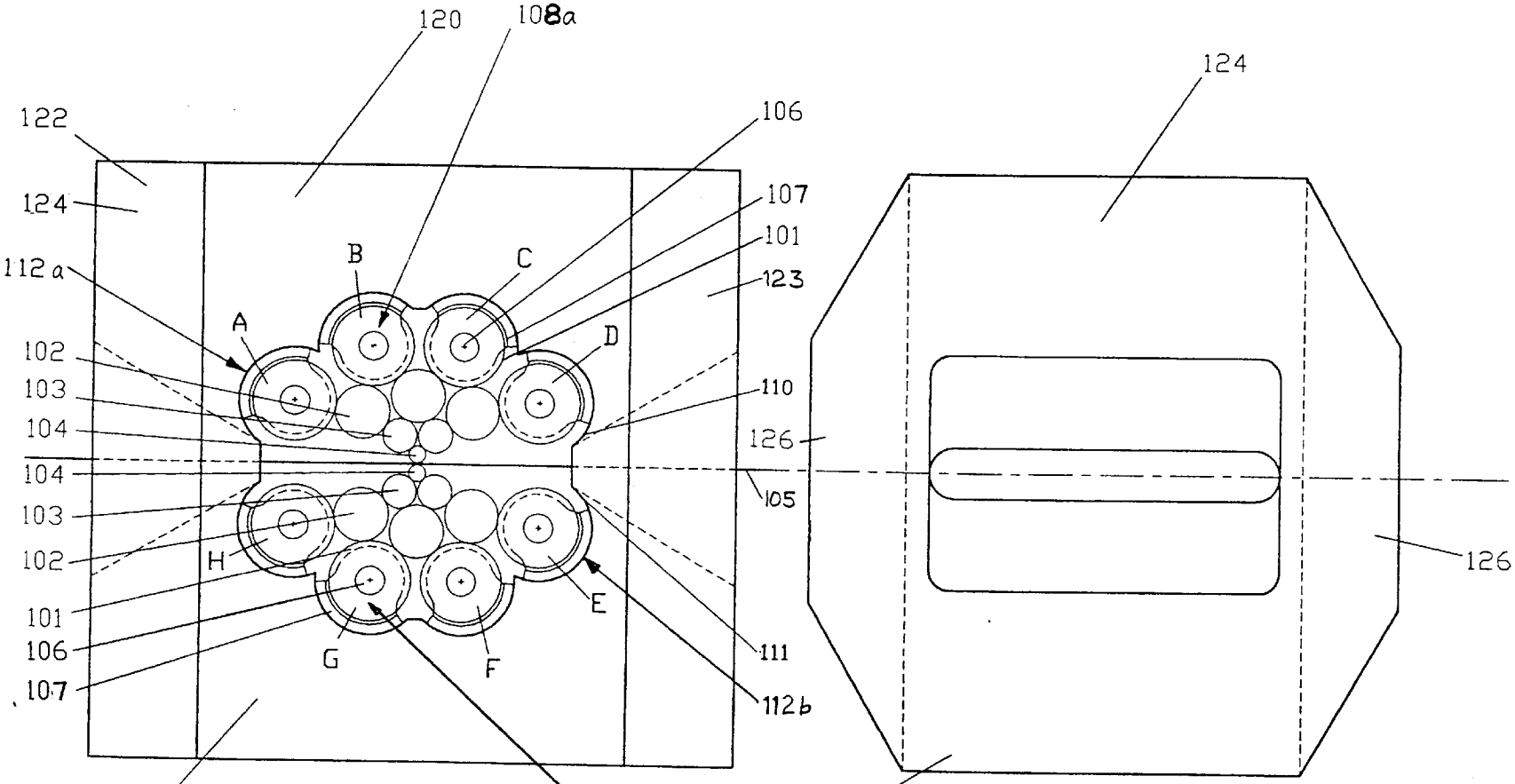
FIG. 1b ( PRIOR ART )
FIG. 1a ( PRIOR ART )
FIGS. 1*a* and 1*b* are, respectively, front and side elevational views of a prior art monobloc housing for a cluster mill.
Figure 2A:
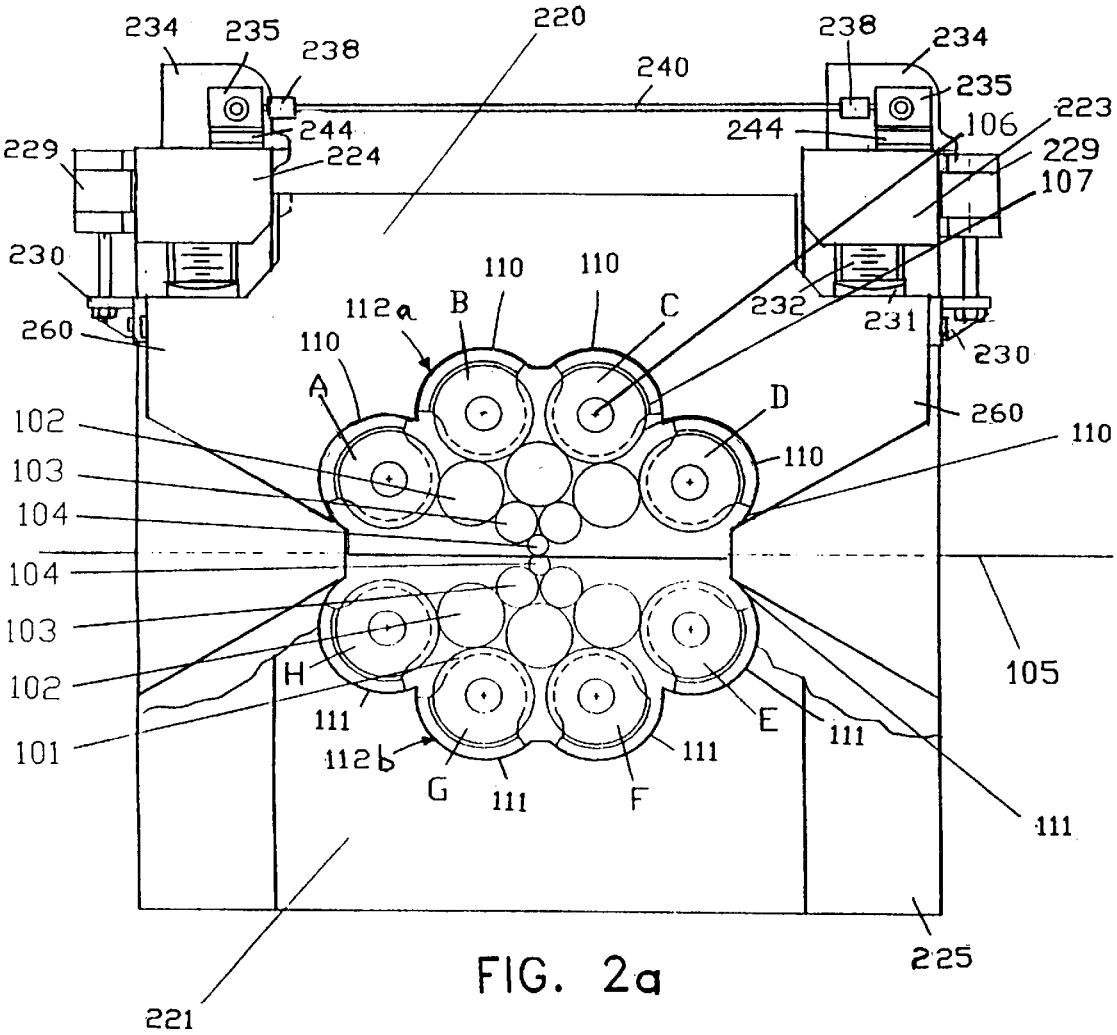
FIGS. 2*a* and 2*b* are, respectively, front and side elevational views of a housing according to the present invention.

For both of the cluster mill housing types shown in the drawings, the housings or housing elements are provided with four upper partial bores 110 and four lower partial bores 111 (see FIGS. 1*a* and 2*a*). These upper and lower partial bores define the periphery of the upper and lower portions of the roll cavity of the housing. In a monobloc housing, such as that of FIG. 1*a*, the roll cavity constitutes a single cavity, generally indicated at 112. In a two part mill housing, such as that of FIG. 2*a*, the upper portion (generally indicated at 112*a*) of the roll cavity is formed in the upper housing part and the lower portion (generally indicated at 112*b*) of the roll cavity is formed in the lower housing part. As is best shown in FIGS. 1*a*, work rolls 104, between which the roll gap is formed and between which the strip 105 passes and is rolled, are each supported by two first intermediate rolls 103. The two first intermediate rolls 103 are supported by three second intermediate rolls 102 which, in turn, are supported by four sets of caster bearings 101. As is well known in the art, each set of caster bearings 101 is mounted on a common shaft 106, and this shaft is supported against the adjacent one of the mill housing partial bores 110 or 111 by a set of saddles 107 being located at each end of the shaft 106, and between each caster bearing 101 and its neighbor on the shaft 106. Each assembly of caster bearings 101, shaft 106 and saddles 107 is known as a backing assembly, there being 8 backing assemblies in all. Conventionally, the 8 backing assemblies are designated A through H as shown in FIG. 1 and as viewed from the operator's side of the mill. Each set of one work roll 104, two first intermediate rolls 103, three second intermediate rolls 102 and four backing assemblies A–D or E–H is known as roll cluster. There are two roll clusters, an upper one generally indicated at 108*a* and a lower one generally indicated at 108*b*. Such clusters are known in the art as 1-2-3-4 or 20-high clusters. This invention applies to mills having this cluster type and also to mills having the cluster type well known in the art as 1-2-3 or 12-high clusters. Each 12-high cluster comprises one work roll, two intermediate rolls and three backing assemblies.

The monobloc housings of FIGS. 1*a* and 1*b* can be described as consisting of a top portion 120, in which partial bores 110 are formed, a bottom portion 121 in which partial bores 111 are formed, and two side frame portions 122 (left side) and 123 (right side) which connect the top and bottom portions. Each side frame portion consists of an upper beam portion 124 and a lower beam portion 125, these beam portions being connected together at their ends by the column portions 126 (see FIG. 1*b*). During rolling, the action of the roll separating force tends to force the top portion 120 up and the bottom portion 121 down. This force is transmitted by shear through top and bottom portions 120 and 121 to beam portions 124 and 125 respectively of the side frame portions 122 and 123, and the separating force is reacted by tension in column portions 126.

Figure 2B:
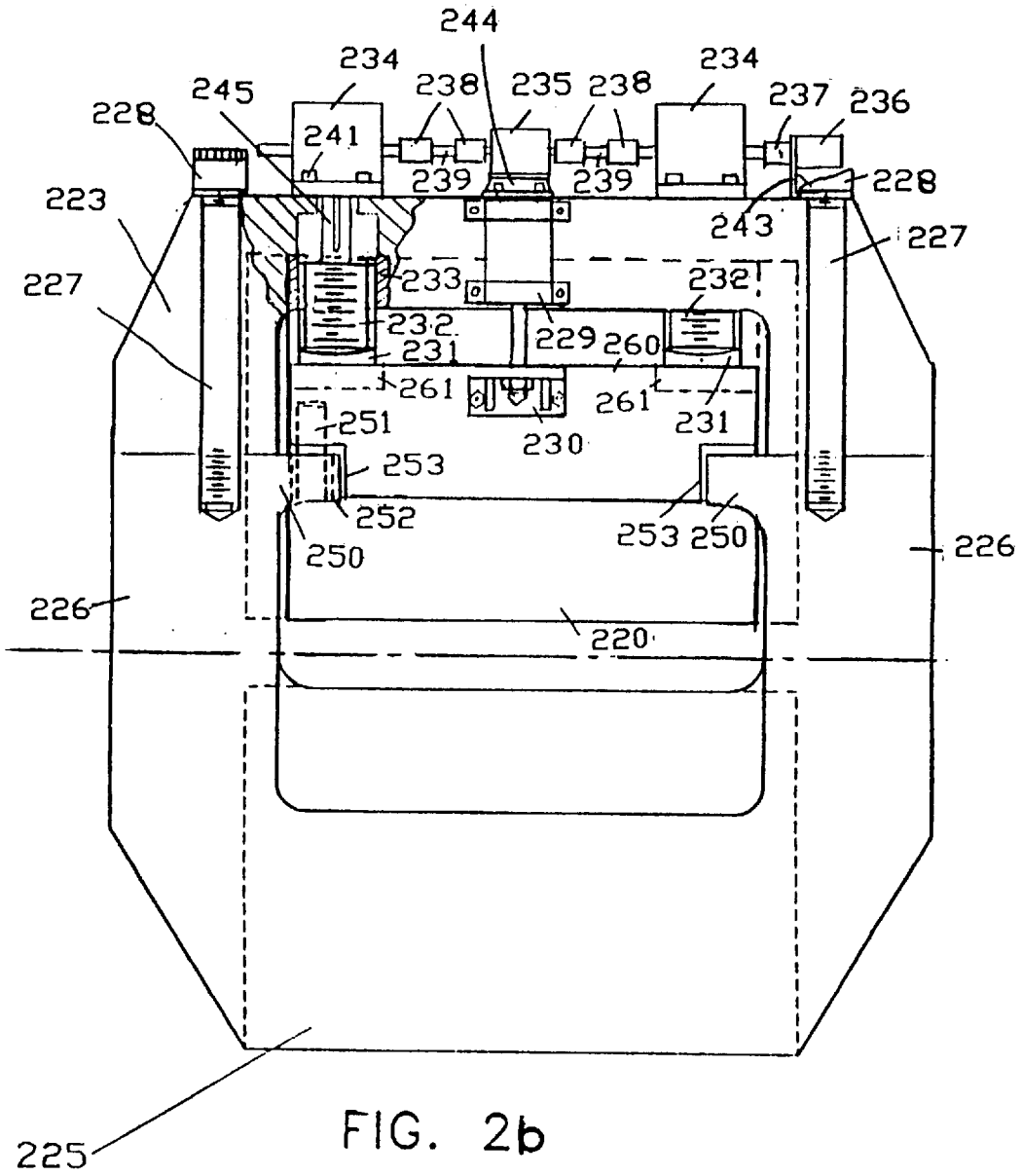
Figure 3:
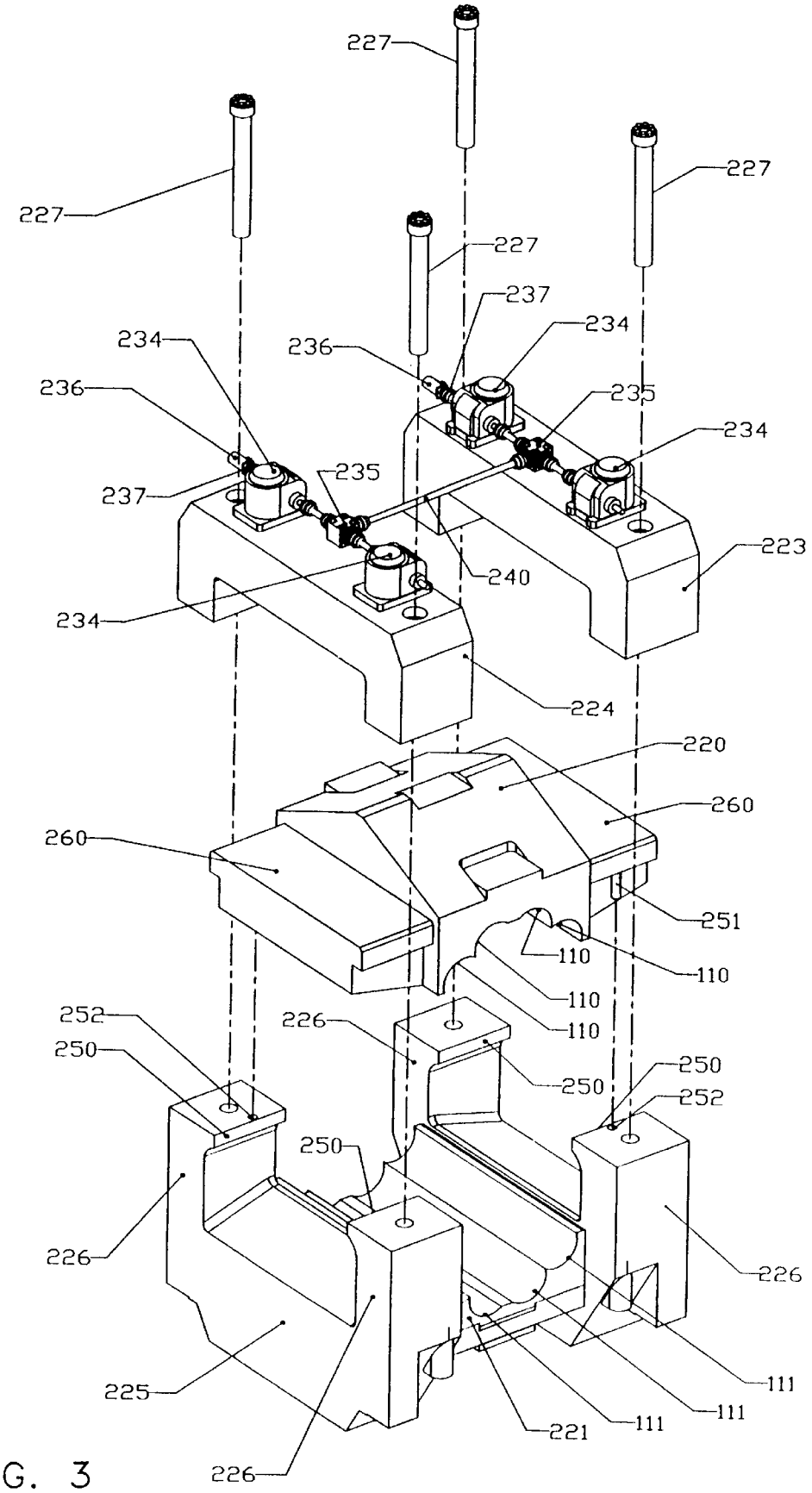
FIG. 3 is an exploded perspective view of the mill of the present invention.

In the case of the housings of FIGS. 1*a* and 1*b* and of FIGS. 2*a* and 2*b*, an eccentric (not shown) is mounted between each saddle 107 and its shaft 106 on at least some of the backing assemblies A–H. Each eccentric is keyed to its respective shaft, such that rotation of the shaft 106 causes movement of the shaft axis (and hence of caster bearings 101 mounted on that shaft). Backing assemblies B and C, which are so equipped, are used as screwdown means to directly adjust roll gap. Similarly equipped backing assemblies F and G are used for pass line adjustment and thus affect roll gap. Similarly equipped backing assemblies A, H, D and E make adjustment for roll wear and have some affect on roll gap.

The housing of the present invention, shown in FIGS. 2*a* and 2*b*, consists of four separate portions, corresponding to the portions of the monobloc housing of FIGS. 1*a* and 1*b* as follows: Roof portion 220 corresponds to monobloc top portion 120, but includes an ear 260 at each side. Floor portion 221 corresponds to monobloc bottom portion 121, but includes portions 225 and 226 at each side, which, together, correspond to the lower part of each monobloc side frame including lower beam portion 125 and column portions 126.

Bridge members 224 (left) and 223 (right), corresponding to upper beam portions 124, respectively, of side frame portions 122 and 123, are bolted to the floor portion 221 by means of nuts 228 and studs 227, the studs being screwed into the column portions 226 of floor portion 221.

It is envisaged that nuts 228 and studs 227 will be of the type described in U.S. Pat. No. RE33490 and manufactured by the Superbolt Corp. of Carnegie, Pa. This type of bolt can be tightened by one man using ordinary tools to achieve tensions as high as 1 million lbs. or more.

Roof portion 220 is first installed on to floor portion 221 before bridge members 223 and 224 are bolted in place. Shelves 250 are incorporated as cast-in lugs on column portions 226 and recesses 253 are machined in the ears 260 of roof portion 220, which match shelves 250 so that the roof portion can be lowered into place, resting on the shelves. Four such shelves 250 are provided in all, one on each column 226, and four such recesses 253 are provided, one at each end of each ear 260 i.e. one at each of the four corners of roof portion 220. Two of the recesses, at diagonally opposite corners of roof portion 220, are provided with pressed-in guide pins 251. These guide pins engage with corresponding bushings 252 fitted in the corresponding two of the four shelves 250, and serve to guide the roof portion 220 as it is raised and lowered to open and close the housing as described below. It is envisaged that roof and floor portions 220 and 221 will be machined at the same time, and the guide pins 251 and bushings 252 can then be used to align these two portions while the upper and lower housing bores are machined.

It should be noted here that, because the roof portion 220 is guided directly on floor portion 221, the horizontal location of bridge members 223 and 224 on floor portion 221 is not critical, so accurate locating devices such as keys and dowels are not required to assemble these parts together.

After the roof portion is in place, the bridge members 223 and 224 can be assembled, and the assemblies dropped into place on top of the lower housing portions 226, and studs 227 and nuts 228 finally installed and tightened.

Two counterbalance cylinders 229, one mounted on bridge member 223, the other on bridge member 224, and acting on brackets 230 attached to the ends of roof portion 220, are used to support the weight of roof portion 220, to keep the weight off shelves 250 in normal operation, and to keep the roof portion tight against the four large screws 232 which engage with nuts (one of which is shown at 233 in FIG. 2*b*) fitted in bridges 223 and 224. These screws engage with spherical thrust buttons 231 which rest on top of ears 260 of roof portion 220.

A synchronized drive is provided to said four screws 232 so that they all are driven at the same speed and keep the same relative positions at all times. This drive consists of four worm gear reducers 234. These four reducers each have a keyed hollow output shaft (not shown) which engages with a keyed portion 245 of one of screws 232. As each output shaft rotates, it causes the mating screw to rotate, and thus also to move up and down within nut 233. The four worm gear reducers 234 are synchronized together by means of their input shafts, which are coupled together via couplings 238 and spindles 239, and bevel gearboxes 235, and by couplings 238 and spindle 240 between bevel gearboxes 235. Bevel gearboxes 235 are mounted on brackets 244, one of which is mounted on bridge member 223 and the other on bridge member 224. A drive is provided on two of the four worm gear reducers, by means of a hydraulic motor 236 acting via coupling 237 on the free end of the double-ended input shaft of each of said two worm gear reducers. One such drive is shown in FIG. 2*b*. The other such drive will usually be applied to the other worm gear reducer on the same side of the mill. Each hydraulic motor is mounted on a bracket 243, one bracket being mounted on bridge member 223, the other being mounted on bridge member 224.

It is envisaged that couplings 238 will be gear couplings such as those made by Zurn Industries of Erie, Pa. These couplings can be engaged and re-engaged with different gear teeth engaging, thus, achieving indexing of one half of the coupling relative to the other half. This indexing technique will be used to set all the screws to the same position initially, so that the counterbalance cylinders 229 will provide equal force on all four screws 232, and housing roof portion 220 will be level. This will also ensure that all four screws 232 will support an equal share of the roll separating force during rolling of metal strip by the rolling mill.

It should be noted that the drive can be made very light and compact because it is only necessary to operate the drive when the mill is not rolling. Typically the weight of the roof portion of the housing will be less than 5% of the maximum rolling load, and since this weight is counterbalanced by hydraulic cylinders 229, the screws only have to operate against a force of about 2% of the maximum rolling load. This makes this drive very compact, and keeps the cost low.

Load cells 261 are shown in phantom lines in upper housing 220, one underneath each of the four screws 232. These can be optionally included for applications where an indication of roll separating force is required when rolling.

With this arrangement, a mill having high rigidity is obtained without the use of hydraulic prestressing. This is achieved, firstly by mechanically prestressing the bridge members 223 and 224 to floor portion 221, and secondly by providing a short stress path through screws 232 and nuts 233 from roof portion 220 to bridge members 223 and 224.

Although this arrangement does not provide for a constant pass line height, it does provide all the other advantages of split housing construction, including ability to open the housing wide to allow easy threading and for removal of strip after strip breaks, the ability to measure roll separating force directly, and the ability to work with a large range of work roll diameters by adjusting positions of screws 232 to suit larger or smaller work rolls. Furthermore it achieves all this at a very small cost because it eliminates the need for prestressing cylinders and achieves opening with a compact, light drive.

What is claimed:

1. A cluster mill housing of substantially the same size and form as a comparable monobloc mill housing and applicable to 20-high and 12-high cluster mills, said mill housing comprising a floor portion, a roof portion and a pair of bridge members, said floor portion having a central portion with a lower roll cavity formed therein, said central portion terminating in oppositely directed end portions, said floor portion having four corners at which four vertical columns are located respectively, said columns terminating in horizontal co-planar surfaces, said central portion, said end portions and said columns of said floor portion comprising an integral, one-piece structure, said roof portion having a central portion with an upper roll cavity formed therein, said central roof portion terminating in oppositely directed ears, each of said bridge members comprising an inverted U-shaped member with a beam-like body and downwardly depending ends terminating in co-planar horizontal surfaces, said horizontal surfaces of each bridge member abutting and being affixed to said horizontal surfaces of a cooperating pair of said columns, said bridge members overlying said roof portion ears, at each corresponding end of said central portion of said floor portion and said central portion of said roof portion a mill housing frame is formed, each mill frame being made up of a lower beam comprising the adjacent end of said floor portion, a pair of vertical column portions comprising the adjacent pair of said floor portion columns and an upper beam comprising the adjacent ear of said roof portion and the adjacent one of said bridge members, a pair of adjustment screws supported in each bridge member and bearing against the adjacent roof member ear, a synchronized drive assembly rotating said four adjustment screws equally and in the same direction to adjust the vertical position of said roof portion with respect to said floor portion, guide means fixing the horizontal position of said roof portion with respect to said floor portion, and hydraulic counterbalance assemblies affixed to said bridge members to support the weight of said roof portion and maintain said roof portion against said adjustment screws.

2. The cluster mill housing claimed in claim 1 wherein said upper and lower roll cavities are configured for a 20-high mill.

3. The cluster mill housing claimed in claim 1 wherein said upper and lower roll cavities are configured for a 12-high mill.

4. The cluster mill housing claimed in claim 1 wherein said two bridge members are fixedly attached to their respective floor portion columns by screw and nut assemblies.

5. The cluster mill housing claimed in claim 1 including shelf surfaces on said floor portion columns for supporting said roof portion during assembly of said mill housing and when hydraulic power to said counterbalance assemblies is switched off.

6. The cluster mill housing claimed in claim 1 wherein said synchronized drive assembly for said four adjustment screws is designed for operation only when the cluster mill is not rolling.

7. The structure claimed in claim 1 wherein each of said counterbalance assemblies comprises a hydraulic cylinder centrally mounted on the side of one of said bridge members and having a piston rod affixed to a bracket mounted centrally of the end of the adjacent one of the roof portion ears.

8. The cluster mill housing claimed in claim 5 wherein said guide means for fixing the horizontal position of said roof portion with respect to said floor portion comprises a pair of vertically oriented pins mounted respectively on diagonally opposite sides of said roof portion ears, a pair of bushings mounted in corresponding ones of said column shelf surfaces, said pins being slidably received within said bushings.

* * * * *